US011320773B2

(12) United States Patent
Kobayashi et al.

(10) Patent No.: US 11,320,773 B2
(45) Date of Patent: May 3, 2022

(54) IMAGE FORMING SYSTEM CAPABLE OF PREDICTING CONSUMED AMOUNT OF CONSUMABLE, PREDICTION DATA OUTPUT METHOD

(71) Applicant: KYOCERA Document Solutions Inc., Osaka (JP)

(72) Inventors: Yasuyoshi Kobayashi, Osaka (JP); Tomoyoshi Sugihara, Osaka (JP); Tadashi Miyazaki, Osaka (JP); Koji Eto, Osaka (JP); Akizo Otani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/322,431

(22) Filed: May 17, 2021

(65) Prior Publication Data

US 2021/0373458 A1 Dec. 2, 2021

(30) Foreign Application Priority Data

May 26, 2020 (JP) ..... JP2020-091253

(51) Int. Cl.
*G03G 15/00* (2006.01)
*B41J 2/175* (2006.01)

(52) U.S. Cl.
CPC ..... *G03G 15/553* (2013.01); *G03G 15/556* (2013.01); *B41J 2002/17569* (2013.01)

(58) Field of Classification Search
CPC ..... G03G 15/553; G03G 15/556; B41J 2002/17569; H04N 1/2346
USPC ..... 399/27
See application file for complete search history.

(56) References Cited

U.S. PATENT DOCUMENTS

2005/0226642 A1* 10/2005 Rodriguez ..... G03G 15/5079 399/27
2013/0236198 A1* 9/2013 Yeh ..... G03G 15/556 399/24
2015/0003847 A1* 1/2015 Yang ..... G03G 15/556 399/27

(Continued)

FOREIGN PATENT DOCUMENTS

JP 2013109202 A 6/2013

*Primary Examiner* — Robert B Beatty
(74) *Attorney, Agent, or Firm* — Alleman Hall Creasman & Tuttle LLP

(57) ABSTRACT

An image forming system includes a recording processing portion, an acquirement processing portion, and an output processing portion. The recording processing portion records a consumed amount of a consumable consumed by an image forming apparatus per predetermined unit time. The acquirement processing portion acquires prediction data that indicates a predicted consumed amount of the consumable per the unit time for a time period from a predetermined standard time, based on a comparison result between: a first record result corresponding to a first time period extending to a reference time; and a second record result corresponding to a predetermined second time period extending to the standard time, among a record result recorded by the recording processing portion, the reference time being a predetermined specific time period earlier than the standard time. The output processing portion outputs the prediction data acquired by the acquirement processing portion.

10 Claims, 6 Drawing Sheets

(56) References Cited

U.S. PATENT DOCUMENTS

| | | | | |
|---|---|---|---|---|
| 2016/0350661 | A1* | 12/2016 | Sato | G06Q 30/0633 |
| 2019/0286038 | A1* | 9/2019 | Seki | H04N 1/00034 |
| 2020/0201230 | A1* | 6/2020 | Ohta | G03G 15/5079 |

* cited by examiner

IMAGE FORMING SYSTEM CAPABLE OF PREDICTING CONSUMED AMOUNT OF CONSUMABLE, PREDICTION DATA OUTPUT METHOD

INCORPORATION BY REFERENCE

This application is based upon and claims the benefit of priority from the corresponding Japanese Patent Application No. 2020-091253 filed on May 26, 2020, the entire contents of which are incorporated herein by reference.

BACKGROUND

The present disclosure relates to an image forming system and a prediction data output method.

There is known an image forming apparatus that forms an image using a consumable such as toner. In addition, there is known, as a related technology, an image forming apparatus that predicts a consumed amount of a consumable for a time period from the current time, based on the past record result of daily consumed amount of the consumable. Specifically, in the image forming apparatus of the related technology, a daily consumed amount of the consumable recorded during the past one year included in the past record result is acquired as a predicted daily consumed amount of the consumable for a time period from the current time.

SUMMARY

An image forming system according to an aspect of the present disclosure includes a recording processing portion, an acquirement processing portion, and an output processing portion. The recording processing portion records a consumed amount of a consumable consumed by an image forming apparatus per predetermined unit time. The acquirement processing portion acquires prediction data that indicates a predicted consumed amount of the consumable per the unit time for a time period from a predetermined standard time, based on a comparison result between a first record result and a second record result among a record result recorded by the recording processing portion, the first record result corresponding to a first time period extending to a reference time, the second record result corresponding to a predetermined second time period extending to the standard time, the reference time being a predetermined specific time period earlier than the standard time. The output processing portion outputs the prediction data acquired by the acquirement processing portion.

A prediction data output method according to another aspect of the present disclosure includes: recording a consumed amount of a consumable consumed by an image forming apparatus per predetermined unit time; acquiring prediction data that indicates a predicted consumed amount of the consumable per the unit time for a time period from a predetermined standard time, based on a comparison result between a first record result and a second record result among a record result of the consumed amount, the first record result corresponding to a first time period extending to a reference time, the second record result corresponding to a predetermined second time period extending to the standard time, the reference time being a predetermined specific time period earlier than the standard time; and outputting the prediction data.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Image Forming System 100]

Figure 1:
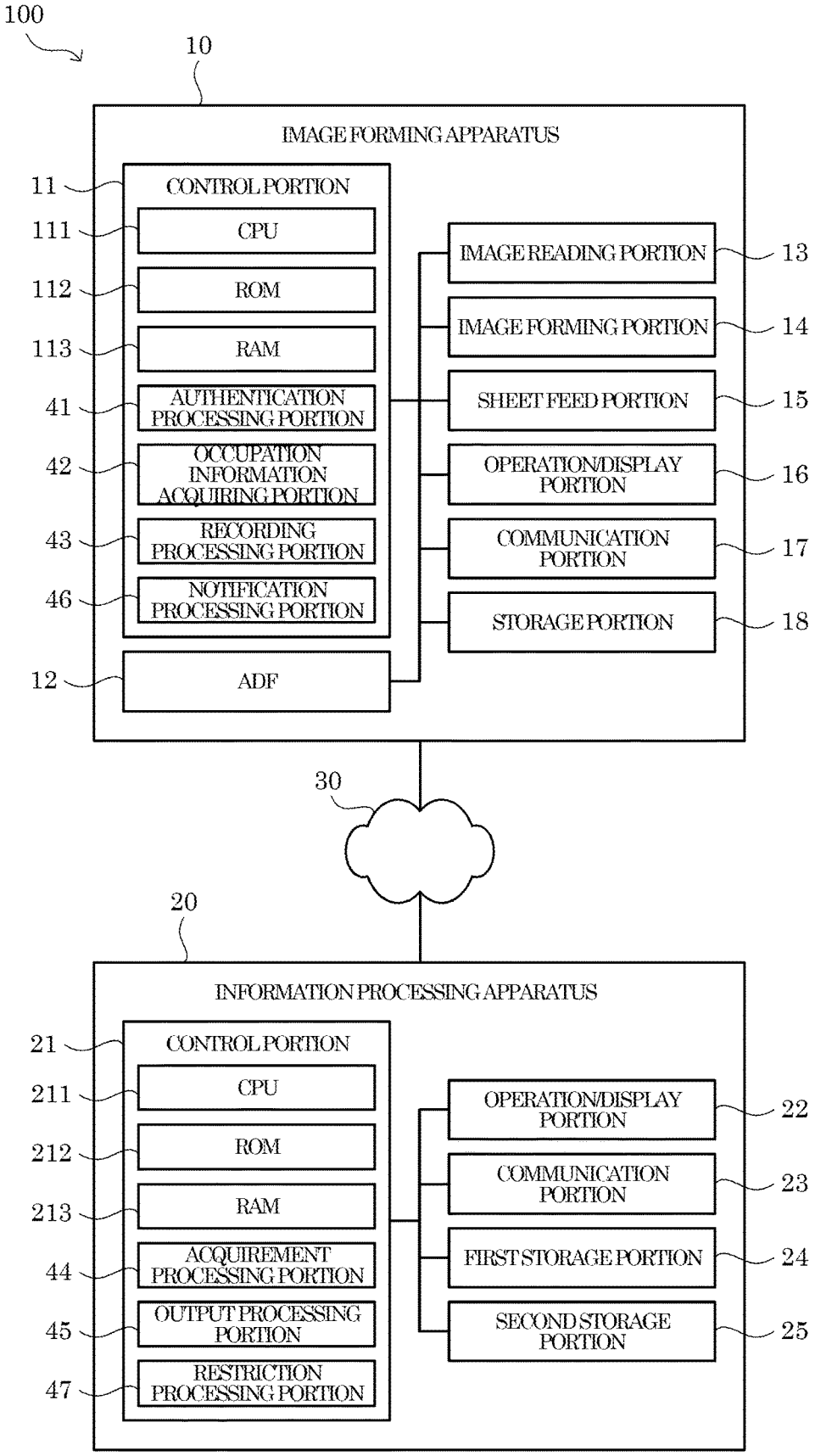
FIG. 1 is a block diagram showing a configuration of an image forming system according to an embodiment of the present disclosure.

As shown in FIG. 1, an image forming system 100 according to the embodiment of the present disclosure includes an image forming apparatus 10 and an information processing apparatus 20. In the image forming system 100, the image forming apparatus 10 and the information processing apparatus 20 are communicably connected with each other via a communication network 30. For example, the communication network 30 is the Internet or a LAN (Local Area Network).

[Image Forming Apparatus 10]

The image forming apparatus 10 is configured to execute a print process to form an image consuming a consumable. For example, the consumable includes toner and a sheet.

For example, the image forming apparatus 10 is a multifunction peripheral having a plurality of functions such as a scan function to read image data from a document sheet, a print function to form an image based on image data, a facsimile function, and a copy function. It is noted that the image forming apparatus 10 may be a printer, a facsimile apparatus, or a copier.

As shown in FIG. 1, the image forming apparatus 10 includes a control portion 11, an ADF (Auto Document Feeder) 12, an image reading portion 13, an image forming portion 14, a sheet feed portion 15, an operation/display portion 16, a communication portion 17, and a storage portion 18.

The control portion 11 includes control equipment such as a CPU 111, a ROM 112, and a RAM 113. The CPU 111 is a processor that executes various calculation processes. The ROM 112 is a nonvolatile storage device in which various information such as control programs for causing the CPU 111 to execute various processes are preliminarily stored. The RAM 113 is a volatile storage device that is used as a temporary storage memory (working area) for the various processes executed by the CPU 111. In the control portion 11, the CPU 111 executes the various control programs preliminarily stored in the ROM 112. This allows the image forming apparatus 10 to be controlled comprehensively by the control portion 11. It is noted that the control portion 11 may be formed as an electronic circuit such as an integrated circuit (ASIC), and may be a control portion provided independently of a main control portion that comprehensively controls the image forming apparatus 10.

The ADF 1 includes a document sheet setting portion, a plurality of conveyance rollers, a document sheet pressing, and a document sheet discharge portion and conveys a document sheet so that it is read by the image reading portion 13.

The image reading portion 13 includes a document sheet table, a light source, a plurality of mirrors, an optical lens, and a CCD, and is configured to read an image from a document sheet. The image reading portion 13 outputs image data corresponding to the read image.

The image forming portion 14 forms an image on a sheet by an electrophotographic method based on image data output from the image reading portion 13. In addition, the image forming portion 14 forms an image on a sheet by an electrophotographic method based on image data input from an external communication apparatus or from a storage device such as a USB memory connected to the image forming apparatus 10. For example, the image forming portion 14 includes a plurality of image forming units, a laser scanning unit (LSU), an intermediate transfer belt, a secondary transfer roller, a fixing device, and a sheet discharge tray, wherein the plurality of image forming units respectively correspond to colors: cyan, magenta, yellow, and black. It is noted that the image forming portion 14 may form an image on a sheet by an inkjet method. In this case, the consumable may include ink.

The sheet feed portion 15 includes a sheet feed cassette, a manual feed tray, and a plurality of conveyance rollers, and supplies sheets one by one to the image forming portion 14. The image forming portion 14 forms an image on a sheet supplied from the sheet feed portion 15, based on the image data.

The operation/display portion 16 includes a display portion and an operation portion. The display portion is, for example, a liquid crystal display and displays various types of information in response to control instructions from the control portion 11. The operation portion is composed of, for example, operation keys or a touch panel through which various types of information are input to the control portion 11 in response to user operations.

The communication portion 17 is a communication interface configured to perform wired or wireless data communications with external communication apparatuses such as the information processing apparatus 20 connected via the communication network 30.

The storage portion 18 is a nonvolatile storage device. For example, the storage portion 18 is a storage device such as: a nonvolatile memory such as a flash memory or an EEPROM; an SSD (Solid State Drive); or an HDD (Hard Disk Drive).

The storage portion 18 stores a plurality of pieces of authentication information respectively corresponding to users of the image forming apparatus 10. The authentication information is used to authenticate the users of the image forming apparatus 10. For example, each piece of authentication information is composed of a user name and a password.

[Information Processing Apparatus 20]

The information processing apparatus 20 is a server configured to execute information processing based on data transmitted from the image forming apparatus 10 and output a processing result.

As shown in FIG. 1, the information processing apparatus 20 includes a control portion 21, an operation/display portion 22, a communication portion 23, a first storage portion 24, and a second storage portion 25.

The control portion 21 includes control equipment such as a CPU 211, a ROM 212, and a RAM 213. The configurations of the CPU 211, the ROM 212, and the RAM 213 are respectively the same as those of the CPU 111, the ROM 112, and the RAM 113 of the image forming apparatus 10. It is noted that the control portion 21 may be formed as an electronic circuit such as an integrated circuit (ASIC), and may be a control portion provided independently of a main control portion that comprehensively controls the information processing apparatus 20.

The operation/display portion 22 includes a display portion and an operation portion. The display portion is, for example, a liquid crystal display and displays various types of information in response to control instructions from the control portion 21. The operation portion is composed of, for example, a keyboard, a mouse, and a touch panel through which various types of information are input to the control portion 21 in response to user operations.

As is the case with the communication portion 17, the communication portion 23 is a communication interface.

As is the case with the storage portion 18, the first storage portion 24 is a nonvolatile storage device. The first storage portion 24 stores log data that is transmitted from the image forming apparatus 10. The log data includes information concerning a print job executed by the image forming apparatus 10. Specifically, the log data includes: an execution date/time of the print job; a consumed amount of the consumable consumed in the print job; and occupation information that indicates an occupation of a user who has input an instruction to execute the print job. It is noted that the log data may not include the occupation information.

As is the case with the storage portion 18, the second storage portion 25 is a nonvolatile storage device. The second storage portion 25 preliminarily stores user information of users who are authenticated by the image forming apparatus 10. For example, each piece of user information includes a user's name, address, age, date of birth, and occupation. For example, the user's occupation includes collage student, company employee, self-employed, housewife, and unemployed. It is noted that the first storage portion 24 and the second storage portion 25 may be storage areas that are individually provided in one storage device.

Meanwhile, there is known, as a related technology, an image forming apparatus that predicts an amount of a consumable for a time period from the current time, based on the past record of daily consumed amount of the consumable. Specifically, in the image forming apparatus of the related technology, a daily consumed amount of the consumable recorded during the past one year included in the past record result is acquired as a predicted daily consumed amount of the consumable for a time period from the current time.

However, in a case where there is a yearly event in which a large amount of the consumable is consumed and the schedule of the event changes every year, the accuracy of the prediction about the consumed amount of the consumable lowers in the image forming apparatus of the related technology.

For example, one example of the yearly event is a final exam held by a collage located near the image forming apparatus 10. When the final exam is held by the collage near the image forming apparatus 10, students of the collage would use the image forming apparatus 10 to print or copy materials such as lecture notebooks for studying for the exam.

On the other hand, in the image forming system 100 according to the embodiment of the present disclosure, it is possible to improve the prediction accuracy of the consumed amount of the consumable as described in the following.

Specifically, as shown in FIG. 1, the control portion 11 of the image forming apparatus 10 includes an authentication processing portion 41, an occupation information acquiring portion 42, a recording processing portion 43, and a notification processing portion 46. The control portion 11 functions as the authentication processing portion 41, the occupation information acquiring portion 42, the recording processing portion 43, and the notification processing portion 46 by executing the control programs preliminarily stored in the ROM 112 or the storage portion 18.

In addition, as shown in FIG. 1, the control portion 21 of the information processing apparatus 20 includes an acquirement processing portion 44, an output processing portion 45, and a restriction processing portion 47. The control portion 21 functions as the acquirement processing portion 44, the output processing portion 45, and the restriction processing portion 47 by executing the control programs preliminarily stored in the ROM 212, the first storage portion 24, or the second storage portion 25.

The authentication processing portion 41 authenticates the user of the image forming apparatus 10.

Specifically, the authentication processing portion 41 authenticates the user of the image forming apparatus 10 by using the authentication information stored in the storage portion 18.

For example, the authentication processing portion 41 displays, in response to a predetermined user operation performed on the operation/display portion 16, an authentication screen on the operation/display portion 16, wherein the authentication screen is used for a predetermined authentication operation. The authentication processing portion 41 receives the authentication operation on the authentication screen.

For example, the authentication operation is an operation to input the user's name and the password on the operation/display portion 16. It is noted that the authentication operation may be an operation to hold an IC card in which the user's name and the password have been preliminarily registered, over a predetermined position on the surface of the image forming apparatus 10. In this case, the authentication processing portion 41 may execute a predetermined short-range radio communication with the IC card to acquire, as input information, the information registered in the IC card from the IC card.

Thereafter, when the information input by the authentication operation matches any piece of authentication information stored in the storage portion 18, the authentication processing portion 41 authenticates the user. That is, the authentication processing portion 41 allows the user to log in the image forming apparatus 10.

It is noted that the authentication processing portion 41 executes a log-out process to log out a currently logged-in user when a predetermined log-out operation has been performed on the operation/display portion 16, when a predetermined set time has passed, or when another user needs to be logged in.

The occupation information acquiring portion 42 acquires the occupation information that indicates the occupation of the user of the image forming apparatus 10.

For example, the occupation information acquiring portion 42 acquires the occupation information from the second storage portion 25 of the information processing apparatus 20 in which the user information concerning the user who is authenticated by the authentication processing portion 41, has preliminarily been stored. It is noted that the user information may be stored in the IC card. That is, the second storage portion 25 of the present disclosure may be a storage device in which the user information included in the IC card is stored. In addition, the occupation information acquiring portion 42 may display, on the operation/display portion 16, an occupation input screen that is used for input of the user's occupation, and acquire, as the occupation information, information input on the occupation input screen.

The recording processing portion 43 records a consumed amount of the consumable consumed by the image forming apparatus 10 per a predetermined unit time.

Here, the unit time is one day. It is noted that the unit time is not limited to one day, but may be, for example, 12 hours or one week.

Specifically, the recording processing portion 43 records the consumed amount of the consumable per the unit time by storing, in the first storage portion 24 of the information processing apparatus 20, the log data corresponding to each print job executed by the image forming apparatus 10.

For example, when a print job is executed, the recording processing portion 43 generates log data corresponding to the print job. Specifically, the recording processing portion 43 acquires a consumed amount of the consumable consumed by the print job, and generates log data that includes: the acquired consumed amount of the consumable; and the occupation information acquired by the occupation information acquiring portion 42. Subsequently, the recording processing portion 43 stores the generated log data in the first storage portion 24 of the information processing apparatus 20. It is noted that the recording processing portion 43 may acquire the consumed amount of the consumable by a known method.

It is noted that the recording processing portion 43 may record the consumed amount of the consumable per the unit time by storing, instead of the log data, consumed amount data that includes: a consumed amount of the consumable consumed in one day; and a date/time when the consumed amount was acquired, in the first storage portion 24 of the information processing apparatus 20. For example, each time a predetermined time comes, the recording processing portion 43 may acquire a consumed amount of the consumable consumed in the past 24 hours based on the current remaining amount of the consumable and a remaining amount of the consumable 24 hours before. The recording processing portion 43 may then store the consumed amount data that includes: the acquired consumed amount of the consumable; and the current date/time, in the first storage portion 24 of the information processing apparatus 20.

Figure 4:
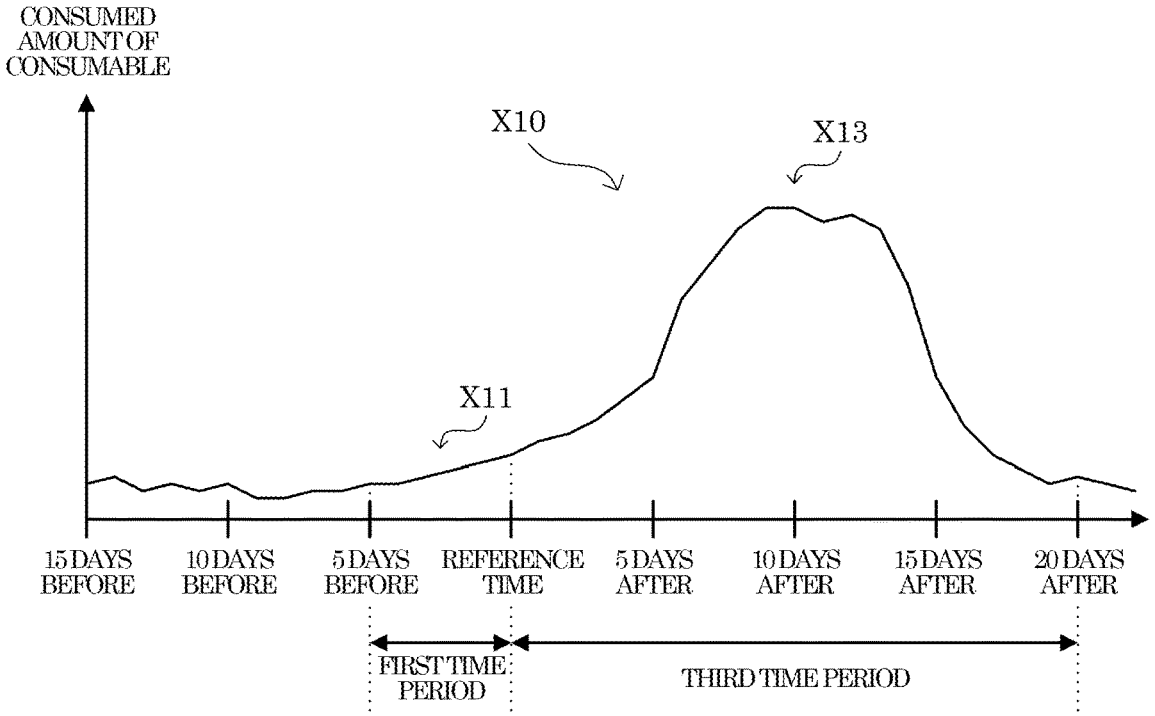
FIG. 4 is a diagram showing an example of a record result of daily consumed amount of a consumable recorded by the image forming system according to the embodiment of the present disclosure.
Figure 5:
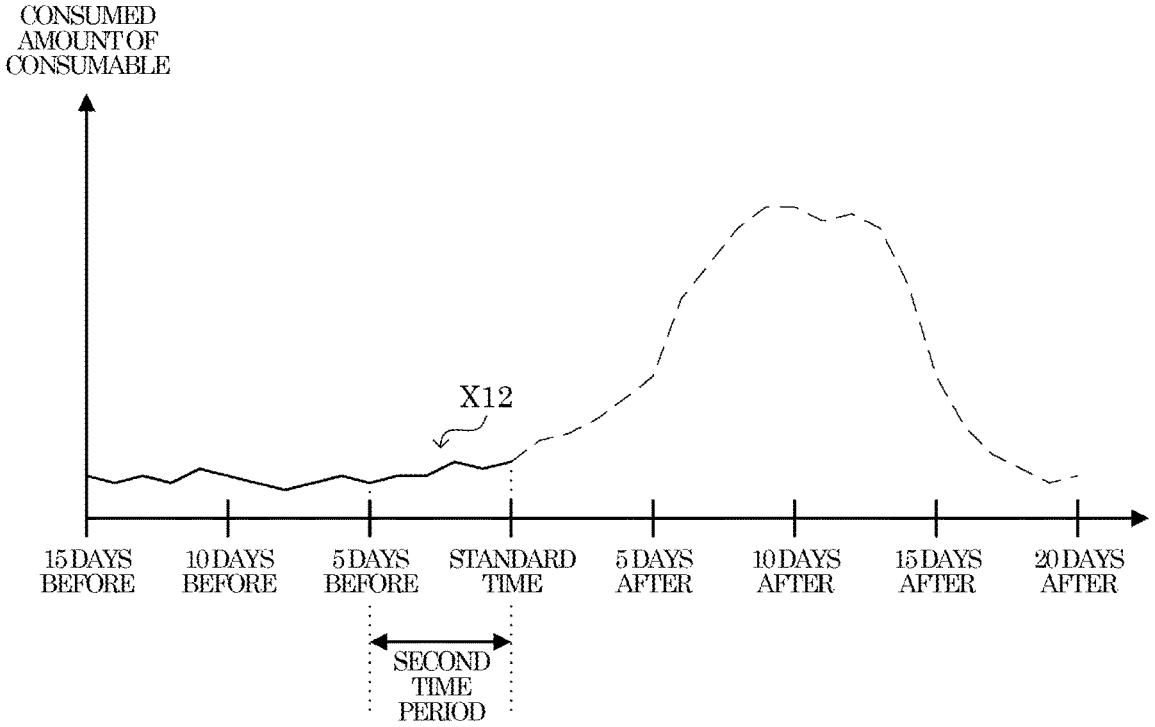
FIG. 5 is a diagram showing an example of the record result of daily consumed amount of the consumable recorded by the image forming system according to the embodiment of the present disclosure.

FIG. 4 and FIG. 5 show examples of the consumed amount of the consumable per the unit time (day) recorded by the recording processing portion 43. Specifically, FIG. 4 shows a consumed amount of the consumable per the unit time (day) during a time period including a reference time described below. In addition, FIG. 5 shows a consumed amount of the consumable per the unit time (day) during a time period extending to a standard time described below.

Figure 6:
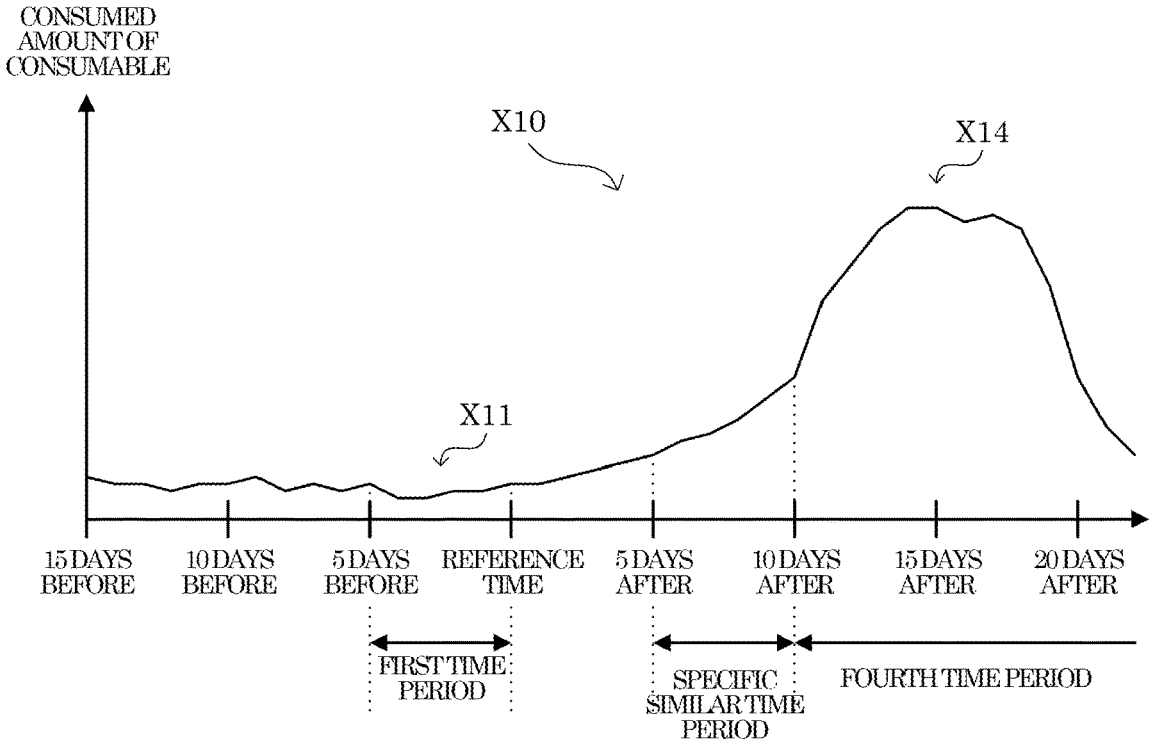
FIG. 6 is a diagram showing another example of the record result of daily consumed amount of the consumable recorded by the image forming system according to the embodiment of the present disclosure.
Figure 7:
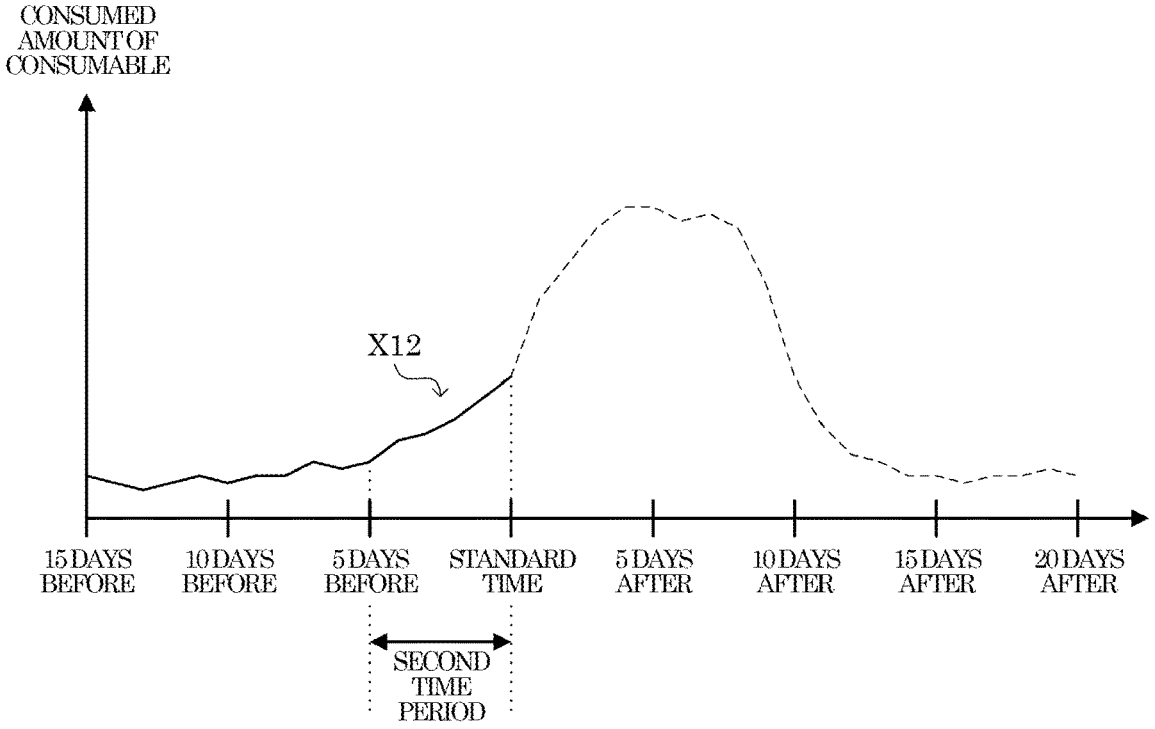
FIG. 7 is a diagram showing another example of the record result of daily consumed amount of the consumable recorded by the image forming system according to the embodiment of the present disclosure.

FIG. 6 and FIG. 7 show other examples of the consumed amount of the consumable per the unit time (day) recorded by the recording processing portion 43.

Figure 8:
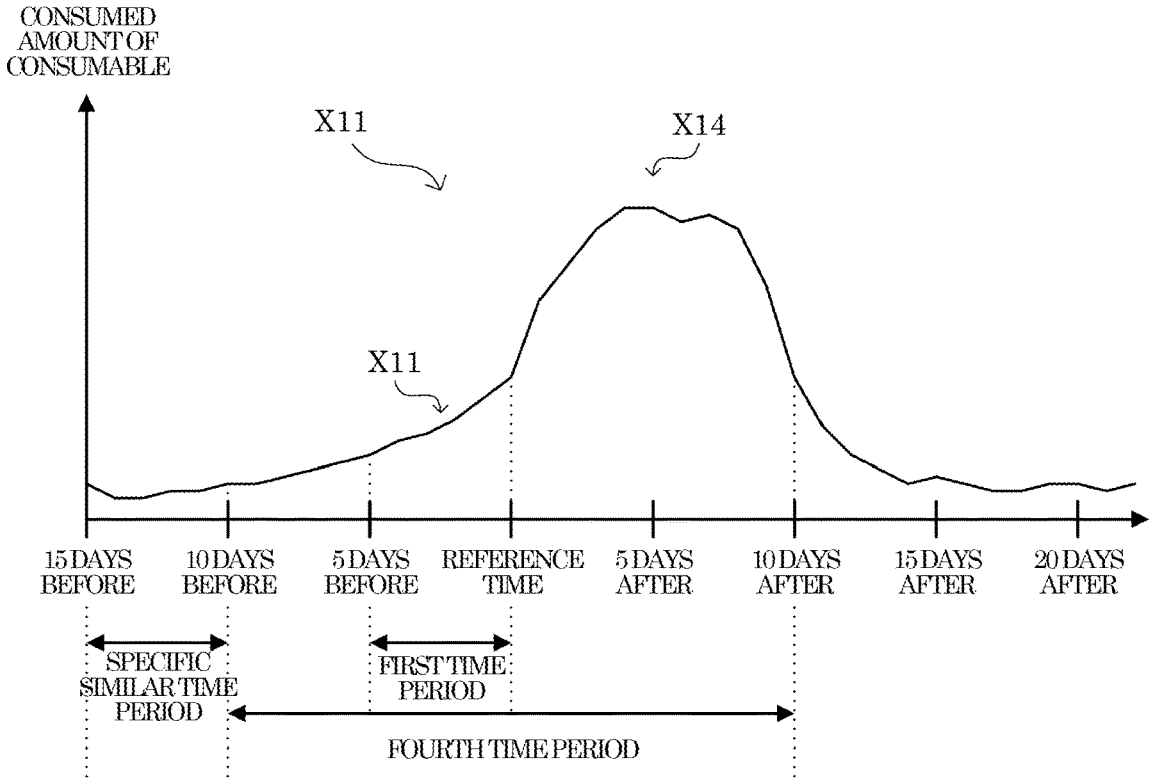
FIG. 8 is a diagram showing another example of the record result of daily consumed amount of the consumable recorded by the image forming system according to the embodiment of the present disclosure.
Figure 9:
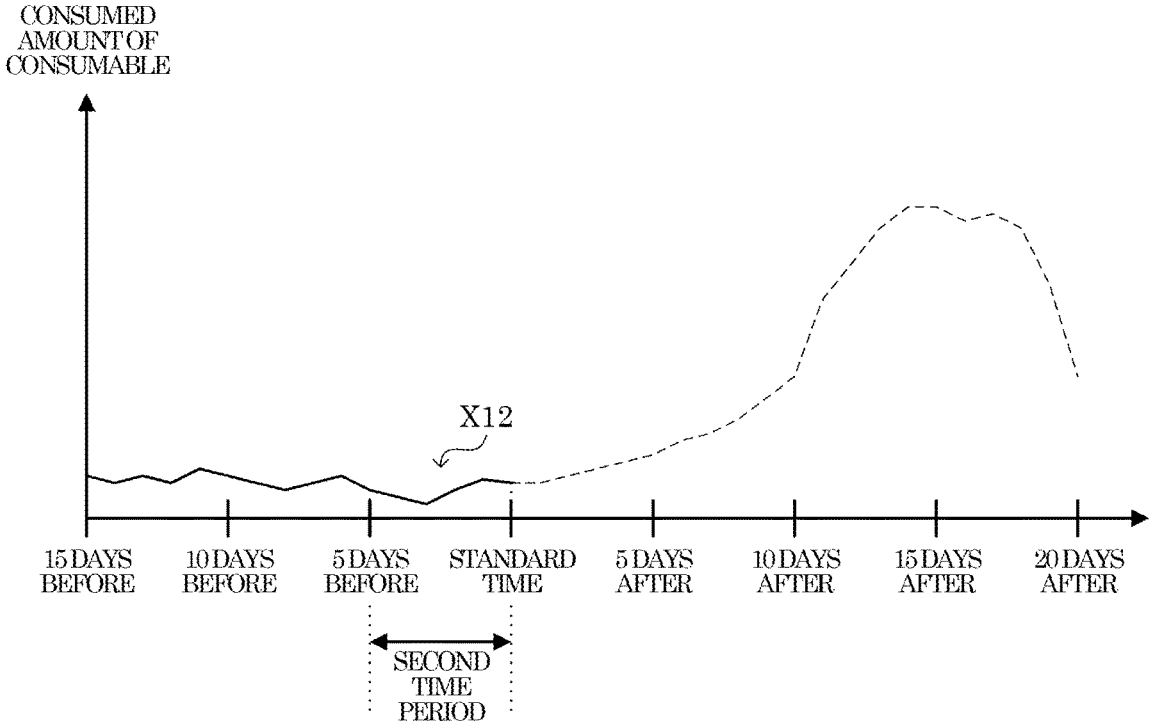
FIG. 9 is a diagram showing another example of the record result of daily consumed amount of the consumable recorded by the image forming system according to the embodiment of the present disclosure.

FIG. 8 and FIG. 9 show other examples of the consumed amount of the consumable per the unit time (day) recorded by the recording processing portion 43.

The acquirement processing portion 44 acquires prediction data that indicates a predicted consumed amount of the consumable per the unit time for a time period from the predetermined standard time.

Here, the standard time is the current time. It is noted that the standard time may be any timing between a timing at which the consumable was consumed most recently in the image forming apparatus 10 and the current time.

Specifically, the acquirement processing portion 44 acquires the prediction data based on a comparison result between a first record result X11 (see FIG. 4) and a second record result X12 (see FIG. 5) among the record result recorded by the recording processing portion 43, wherein the first record result X11 corresponds to a first time period (see FIG. 4) extending to the reference time, and the second record result X12 corresponds to a predetermined second time period (see FIG. 5) extending to the standard time, wherein the reference time is a predetermined specific time period earlier than the standard time.

Here, the specific time period is one year. It is noted that the specific time period may be one week or one month. In addition, the specific time period may be an integral multiple of one week, one month, or one year. In addition, the specific time period may be a length of time that is different from any of the above-described time periods.

In addition, the second time period has a length of five days extending from five days before the standard time to the standard time (see FIG. 5). It is noted that the second time period may have an arbitrary length of time extending to the standard time.

In addition, the first time period has the same length of time as the second time period. It is noted that the first time period may have a different length from the second time period.

For example, the acquirement processing portion 44 determines, based on a predetermined determination condition, whether or not the first record result X11 (see FIG. 4) and the second record result X12 (see FIG. 5) are similar to each other.

For example, the determination condition is that each day in the second time period satisfies a condition that a result of dividing the consumed amount of the consumable in a day in the second time period, by the consumed amount of the consumable in a day that is the specific time period earlier than the day in the second time period, is within a predetermined numerical range. In other words, the determination condition is that each day in the second time period satisfies a condition that the change rate of the consumed amount of the consumable between a day in the second time period and a day that is the specific time period earlier than the day in the second time period, is equal to or lower than a predetermined value. For example, the numerical range is from 0.8 to 1.2.

It is noted that the determination condition may be that, for each term included in a numerical expression that represents an approximate line of the second record result X12, a difference between a coefficient of a term in the numerical expression and a coefficient of a corresponding term in a numerical expression that represents an approximate line of the first record result X11, is equal to or lower than an allowable value that is determined in advance in correspondence with the term. In addition, the determination condition may be an arbitrary condition for determining whether or not the first record result X11 is similar to the second record result X12.

FIG. 4 and FIG. 5 show examples of the first record result X11 and the second record result X12 that are determined as similar to each other by the acquirement processing portion 44. In addition, FIG. 6 and FIG. 7 show examples of the first record result X11 and the second record result X12 that are determined as dissimilar to each other by the acquirement processing portion 44. In addition, FIG. 8 and FIG. 9 show examples of the first record result X11 and the second record result X12 that are determined as dissimilar to each other by the acquirement processing portion 44.

Upon determining, based on the determination condition, that the first record result X11 and the second record result X12 are similar to each other (see FIG. 4 and FIG. 5), the acquirement processing portion 44 acquires, as the prediction data, data representing a third record result X13 that corresponds to a third time period (see FIG. 4) extending from the reference time, from the record result recorded by the recording processing portion 43. For example, the third time period is a period of 20 days extending from the reference time. It is noted that the third time period may be a period of an arbitrary length extending from the reference time.

The dotted line in FIG. 5 indicates a predicted consumed amount of the consumable per the unit time indicated by the prediction data corresponding to the third record result X13.

On the other hand, upon determining, based on the determination condition, that the first record result X11 and the second record result X12 are dissimilar to each other (see FIG. 6 to FIG. 9), the acquirement processing portion 44 detects a specific similar time period (see FIG. 6 and FIG. 8) closest to the reference time among similar time periods that correspond to record results that are determined as similar to the second record result X12 based on the determination condition included in a recording time period of the recording processing portion 43.

Subsequently, the acquirement processing portion 44 acquires, as the prediction data, data representing a fourth record result X14 that corresponds to a fourth time period (see FIG. 6 and FIG. 8) extending from the end of the detected specific similar time period. For example, the fourth time period has the same length as the third time period. It is noted that the fourth time period may be a period of an arbitrary length extending from the end of the specific similar time period.

The dotted line in FIG. 7 indicates a predicted consumed amount of the consumable per the unit time indicated by the prediction data corresponding to the fourth record result X14 shown in FIG. 6.

The dotted line in FIG. 9 indicates a predicted consumed amount of the consumable per the unit time indicated by the prediction data corresponding to the fourth record result X14 shown in FIG. 8.

It is noted that, upon determining, based on the determination condition, that the first record result X11 and the second record result X12 are dissimilar to each other, the acquirement processing portion 44 may correct the third record result X13 based on a difference between the first record result X11 and the second record result X12, and acquire, as the prediction data, data representing the corrected third record result X13. In addition, upon determining, based on the determination condition, that the first record result X11 and the second record result X12 do not match each other, the acquirement processing portion 44 may correct the third record result X13 based on a difference between the first record result X11 and the second record result X12, and acquire, as the prediction data, data representing the corrected third record result X13. In addition, in a case where the first time period is shorter than the second time period in the recording time period of the recording processing portion 43, the acquirement processing portion 44 may compare a record result for a time period in the second time period that extends to the end of the second time period and has the same length as the first time period, with the first record result X11.

Here, the acquirement processing portion 44 acquires the prediction data by combining first prediction data and second prediction data, wherein the first prediction data is acquired based on first log data that includes occupation information indicating a predetermined specific occupation among the log data stored in the first storage portion 24, and the second prediction data is acquired based on second log data that is different from the first log data among the log data stored in the first storage portion 24. In other words, the acquirement processing portion 44 acquires the prediction data corresponding to users of all occupations by combining: the first prediction data that is the prediction data corresponding to users of the specific occupation; and the second prediction data that is the prediction data corresponding to users of occupations other than the specific occupation.

The specific occupation is an occupation engaged by the participants of the event. For example, in a case where the event is the final exam held by a collage located near the image forming apparatus 10, the specific occupation is collage student. The specific occupation may be set arbitrarily in accordance with a user operation.

When the log data is divided into the first log data and the second log data, the first log data clearly shows an increasing tendency of the consumed amount of the consumable before the event. As a result, it is possible to improve the accuracy of prediction about the consumed amount of the consumable in the prediction data acquired based on the first prediction data.

It is noted that the acquirement processing portion 44 may acquire, based on the log data stored in the first storage portion 24, the prediction data corresponding to users of all occupations without acquiring the first prediction data and the second prediction data.

The output processing portion 45 outputs the prediction data acquired by the acquirement processing portion 44.

Specifically, the output processing portion 45 transmits the prediction data to the image forming apparatus 10.

It is noted that the output processing portion 45 may transmit the prediction data to a predetermined information processing apparatus that is different from the image forming apparatus 10.

The notification processing portion 46 notifies a shortage timing, wherein the shortage timing is a timing at which a remaining amount of the consumable that is identified based on the prediction data and a remaining amount of the consumable at the standard time, becomes equal to or lower than a predetermined threshold.

It is noted that the control portion 11 of the image forming apparatus 10 may display, on the operation/display portion 16, the prediction data transmitted from the information processing apparatus 20.

The restriction processing portion 47 restricts the acquirement processing portion 44 from acquiring the prediction data based on: a predicted consumed amount of the consumable per the unit time for a time period from the standard time to the current time indicated by the prediction data output from the output processing portion 45; and the consumed amount of the consumable per the unit time for the time period from the standard time to the current time recorded by the recording processing portion 43.

Specifically, the restriction processing portion 47 restricts the acquirement processing portion 44 from acquiring the prediction data while it is determined, based on the determination condition, that the predicted consumed amount of the consumable per the unit time for the time period from the standard time to the current time indicated by the prediction data; and the consumed amount of the consumable per the unit time for the time period from the standard time to the current time recorded by the recording processing portion 43, are similar to each other.

It is noted that the control portion 11 may not include the authentication processing portion 41, the occupation information acquiring portion 42, and the notification processing portion 46. In addition, the control portion 21 may not include the restriction processing portion 47.

[Consumed Amount Recording Process]

Figure 2:
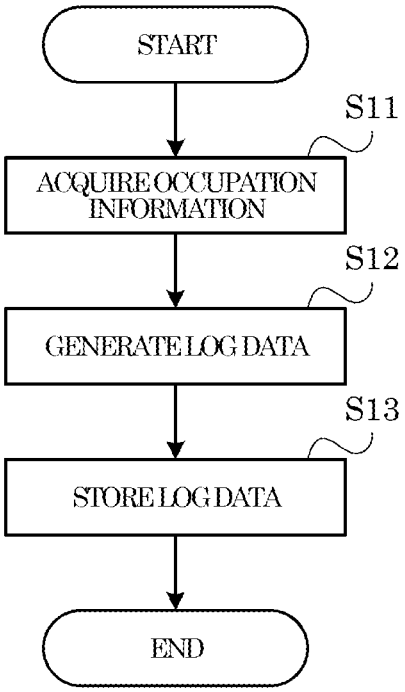
FIG. 2 is a flowchart showing an example of a consumed amount recording process executed in the image forming system according to the embodiment of the present disclosure.

In the following, with reference to FIG. 2, a description is given of an example of the procedure of a consumed amount recording process executed by the control portion 11 in the image forming apparatus 10. Here, steps S11, S12, . . . represent numbers assigned to the processing procedures (steps) executed by the control portion 11. It is noted that the consumed amount recording process is executed each time the print job is executed.

<Step S11>

First, in step S11, the control portion 11 acquires the occupation information. Here, the process of step S11 is executed by the occupation information acquiring portion 42 of the control portion 11.

Specifically, the control portion 11 acquires, from the second storage portion 25 of the information processing apparatus 20, a piece of user information corresponding to a user currently logging in the image forming apparatus 10, and acquires the occupation information included in the acquired piece of user information.

<Step S12>

In step S12, the control portion 11 generates the log data.

Specifically, the control portion 11 acquires a consumed amount of the consumable consumed by the print job that has triggered the execution of the consumed amount recording process, and generates a piece of log data that includes the acquired consumed amount of the consumable and the occupation information acquired in step S11.

<Step S13>

In step S13, the control portion 11 stores the piece of log data generated in step S12 in the first storage portion 24 of the information processing apparatus 20. Here, the processes of steps S12 and S13 are an example of a recording step of the present disclosure, and are executed by the recording processing portion 43 of the control portion 11.

[Prediction Data Output Process]

Figure 3:
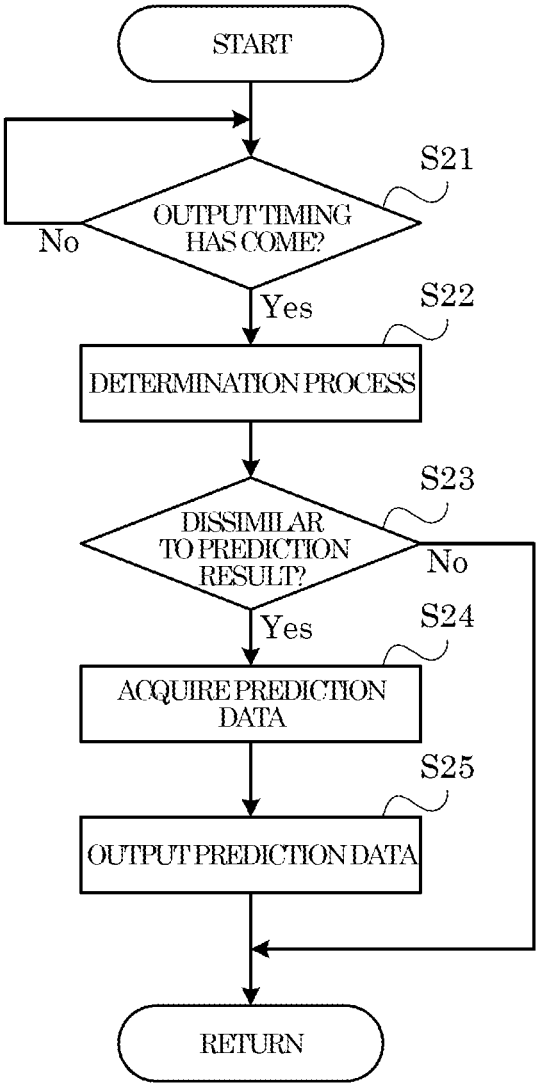
FIG. 3 is a flowchart showing an example of a prediction data output process executed in the image forming system according to the embodiment of the present disclosure.

Next, with reference to FIG. 3, a description is given of an example of the procedure of a prediction data output process executed by the control portion 21 in the information processing apparatus 20.

<Step S21>

First, in step S21, the control portion 21 determines whether or not a predetermined output timing has come.

For example, the output timing is a timing that comes in a predetermined period such as daily. It is noted that the output timing may be a timing at which an output instruction of the prediction data is input.

Here, upon determining that the output timing has come (Yes side at S21), the control portion 21 moves the process to step S22. In addition, upon determining that the output timing has not come (No side at S21), the control portion 21 waits at step S21 for the output timing to come.

<Step S22>

In step S22, the control portion 21 executes a determination process to determine, based on the determination condition, whether or not a predicted consumed amount of the consumable per the unit time for the time period from the standard time to the current time indicated by the prediction data output in the prediction data output process executed immediately before; and a measured consumed amount of the consumable per the unit time for the time period from the standard time to the current time indicated by the log data stored in the first storage portion 24, are similar to each other.

<Step S23>

In step S23, the control portion 21 branches the process according to the result of the determination process executed in step S22. Here, the processes of steps S22 and S23 are executed by the restriction processing portion 47 of the control portion 21.

Specifically, upon determining, in the determination process, that the predicted consumed amount of the consumable per the unit time for the time period from the standard time to the current time and the measured consumed amount of the consumable per the unit time for the time period from the standard time to the current time, are dissimilar to each other (Yes side at S23), the control portion 21 moves the process to step S24.

In addition, upon determining, in the determination process, that the predicted consumed amount of the consumable per the unit time for the time period from the standard time to the current time and the measured consumed amount of the consumable per the unit time for the time period from the standard time to the current time, are similar to each other (No side at S23), the control portion 21 moves the process to step S21. With this configuration, it is possible to restrict the process of acquiring the prediction data while the consumed amount of the consumable changes along the prediction data output immediately before.

<Step S24>

In step S24, the control portion 21 acquires the prediction data. Here, the process of steps S24 is an example of an acquirement step of the present disclosure, and is executed by the acquirement processing portion 44 of the control portion 21.

Specifically, the control portion 21 acquires the first prediction data based on the first log data. In addition, the control portion 21 acquires the second prediction data based on the second log data. The control portion 21 then acquires the prediction data by combining the acquired first prediction data and second prediction data.

<Step S25>

In step S25, the control portion 21 outputs the prediction data acquired in step S24. Here, the process of steps S25 is an example of an output step of the present disclosure, and is executed by the output processing portion 45 of the control portion 21.

Specifically, the control portion 21 transmits the prediction data to the image forming apparatus 10.

Upon receiving the prediction data transmitted from the information processing apparatus 20, the control portion 11 of the image forming apparatus 10 identifies the shortage timing at which the remaining amount of the consumable becomes equal to or lower than the threshold, based on the remaining amount of the consumable at the standard time and the received prediction data. The control portion 11 then notifies the identified shortage timing. This process is executed by the notification processing portion 46 of the control portion 11.

With the above-described configuration, the image forming system 100 acquires the prediction data that indicates a predicted daily consumed amount of the consumable for a time period from the current time, based on the comparison result between the first record result X11 and the second record result X12 among the record result of the daily consumed amount of the consumable, wherein the first record result X11 corresponds to the first time period extending to the reference time that is one year earlier than the current time, and the second record result X12 corresponds to the second time period extending to the current time. As a result, compared with a configuration where, among the record result of the daily consumed amount of the consumable, the record result for a time period from the reference time is acquired as it is as the prediction data, it is possible to improve the prediction accuracy of the consumed amount of the consumable.

It is noted that instead of the control portion 21 of the information processing apparatus 20, the control portion 11 of the image forming apparatus 10 may include the acquirement processing portion 44, the output processing portion 45, and the restriction processing portion 47. In addition, the image forming apparatus 10 may include the first storage portion 24 and the second storage portion 25. In this case, the image forming apparatus 10 is another example of the image forming system of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming system comprising:

a recording processing portion configured to record a consumed amount of a consumable consumed by an image forming apparatus per predetermined unit time;

an acquirement processing portion configured to acquire prediction data that indicates a predicted consumed amount of the consumable per the unit time for a time period from a predetermined standard time, based on a comparison result between a first record result and a second record result among record results recorded by the recording processing portion, the first record result corresponding to a first time period extending to a reference time, the second record result corresponding to a predetermined second time period extending to the standard time, the reference time being a predetermined specific time earlier than the standard time; and an output processing portion configured to output the prediction data acquired by the acquirement processing portion.

2. The image forming system according to claim 1, wherein the first time period has a same length of time as the second time period, and when the acquirement processing portion determines, based on a predetermined determination condition, that the first record result and the second record result are similar to each other, the acquirement processing portion acquires, as the prediction data, data representing a record result that corresponds to a time period extending from the reference time, from the record result recorded by the recording processing portion.

3. The image forming system according to claim 2, wherein when the acquirement processing portion determines, based on the determination condition, that the first record result and the second record result are dissimilar to each other, the acquirement processing portion acquires, as the prediction data, data representing a record result that corresponds to a time period extending from an end of a specific similar time period that is closest to the reference time among similar time periods that correspond to record results that are determined as similar to the second record result based on the determination condition included in a recording time period of the recording processing portion.

4. The image forming system according to claim 1, further comprising:

a restriction processing portion configured to restrict the acquirement processing portion from acquiring the prediction data based on: a predicted consumed amount of the consumable per the unit time for a time period from the standard time to a current time indicated by the prediction data output from the output processing portion; and the consumed amount of the consumable per the unit time for the time period from the standard time to the current time recorded by the recording processing portion.

5. The image forming system according to claim 1, wherein the recording processing portion records the consumed amount of the consumable consumed by the image forming apparatus per the unit time by storing, in a predetermined first storage portion, log data corresponding to each print job executed by the image forming apparatus, the log data including: an execution date/time of each print job; and a consumed amount of the consumable consumed in each print job.

6. The image forming system according to claim 5, further comprising:

an occupation information acquiring portion configured to acquire occupation information that indicates an occupation of each user, wherein the log data includes the occupation information corresponding to each user who has input an instruction to execute a print job, and the acquirement processing portion acquires the prediction data by combining first prediction data and second prediction data, wherein the first prediction data is acquired based on first log data that includes occupation information indicating a predetermined specific occupation among the log data stored in the first storage portion, and the second prediction data is acquired based on second log data that is different from the first log data among the log data stored in the first storage portion.

7. The image forming system according to claim 6, further comprising:

an authentication processing portion configured to authenticate a user, wherein the occupation information acquiring portion acquires the occupation information from a second storage portion that preliminarily stores user information of each user who is authenticated by the authentication processing portion.

8. The image forming system according to claim 1, further comprising:

a notification processing portion configured to notify a shortage timing that is a timing at which a remaining amount of the consumable that is identified based on the prediction data and a remaining amount of the consumable at the standard time, becomes equal to or lower than a predetermined threshold.

9. The image forming system according to claim 1, wherein the unit time is one day, and the specific time period is an integral multiple of one week, one month, or one year.

10. A prediction data output method, comprising:

recording a consumed amount of a consumable consumed by an image forming apparatus per predetermined unit time;

acquiring prediction data that indicates a predicted consumed amount of the consumable per the unit time for a time period from a predetermined standard time, based on a comparison result between a first record result and a second record result among a record result of the consumed amount, the first record result corresponding to a first time period extending to a reference time, the second record result corresponding to a predetermined second time period extending to the standard time, the reference time being a predetermined specific time period earlier than the standard time; and outputting the prediction data.

* * * * *